United States Patent [19]

Kamal

[11] Patent Number: 4,638,708

[45] Date of Patent: Jan. 27, 1987

[54] STRINGED INSTRUMENT

[76] Inventor: Benjelloun Kamal, 45 Sintsink Dr., West, Port Washington, N.Y. 11050

[21] Appl. No.: 842,923

[22] Filed: Mar. 24, 1986

[51] Int. Cl.[4] ..... G10D 3/00

[52] U.S. Cl. ..... 84/293

[58] Field of Search ..... 84/291, 293

[56] References Cited

U.S. PATENT DOCUMENTS

| | | | |
|---|---|---|---|
| 350,693 | 10/1886 | Mustill | 84/293 X |
| 538,205 | 4/1895 | Back | 84/293 |
| 602,695 | 4/1898 | Casolin | 84/293 |
| 1,707,192 | 3/1929 | Overton | 84/293 X |
| 1,747,650 | 2/1930 | Sawyer | 84/293 |
| 2,497,116 | 2/1950 | Dopyera | 84/293 |
| 3,831,485 | 8/1974 | Dopera | 84/293 X |
| 4,290,336 | 9/1981 | Peavey | 84/293 X |

*Primary Examiner*—Lawrence R. Franklin
*Attorney, Agent, or Firm*—Michael I. Kroll

[57] ABSTRACT

An improved stringed instrument is provided that contains a removable neck so that when the stringed instrument is not being used the neck can be removed so that the stringed instrument can be stored in a smaller area. In another form the stringed instrument contains a pivotable neck so that when the stringed instrument is not being used the neck can be pivoted over the body of the instrument so that the stringed instrument can be stored in a smaller area.

4 Claims, 5 Drawing Figures

STRINGED INSTRUMENT

BACKGROUND OF THE INVENTION

1. Field of the Invention

The instant invention relates generally to musical stringed instruments and more specifically it relates to an improved stringed instrument that includes a removable neck or a pivotable neck.

2. Description of the Prior Art

Numerous musical stringed instruments have been provided in prior art that are adapted to contain stationary necks extending from body members therefrom. For example, U.S. Pat. Nos. 3,251,258; 4,201,108 and 4,334,452 all are illustrative of such prior art. While these units may be suitable for the particular purpose to which they address, they would not be as suitable for the purposes of the present invention as heretofore described.

SUMMARY OF THE INVENTION

A primary object of the present invention is to provide an improved stringed instrument that will overcome the shortcomings of the prior art devices.

Another object is to provide an improved stringed instrument that contains a removable neck so that when the stringed instrument is not being used, the neck can be removed in which the stringed instrument can be stored in a smaller area, especially when traveling in a car, van, motorcycle, bicycle and the like.

Another additional object is to provide an improved stringed instrument that contains a pivotable neck so that when the stringed instrument is not being used the neck can be pivoted over the body of the instrument in which the stringed instrument can be stored in a smaller area, especially when traveling in a car, van, motorcyle, bicycle and the like.

An further object is to provide an improved stringed instrument that is simple and easy to use.

A still further object is to provide an improved stringed instrument that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
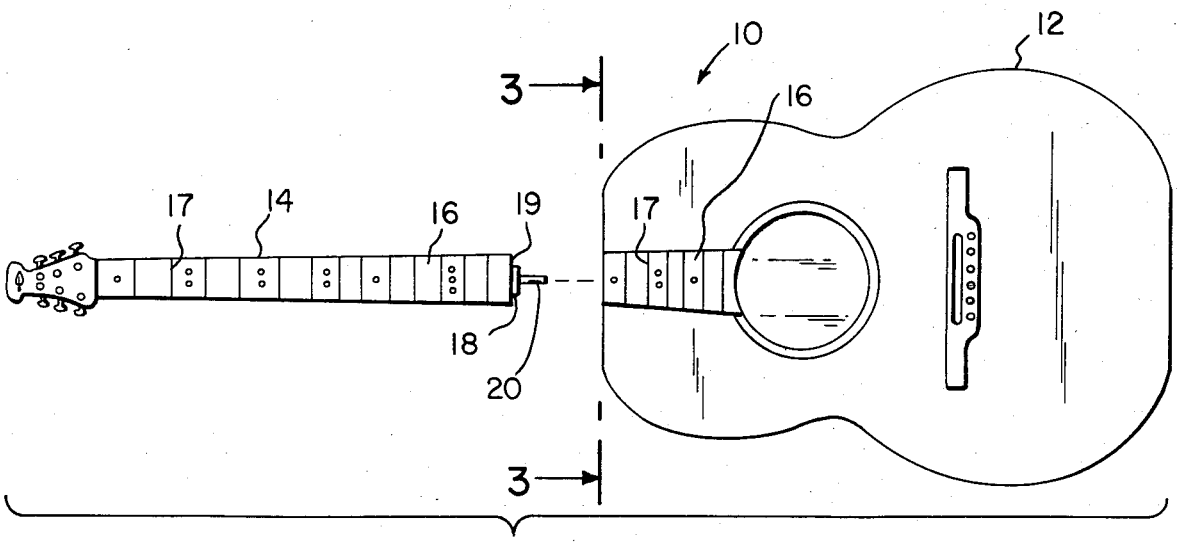
FIG. 1 is an exploded top view of a first form of the invention showing the neck removed from the body of the stringed instrument.
Figure 2:
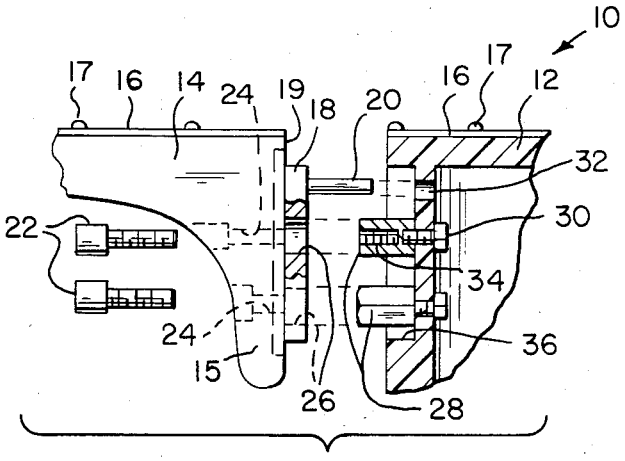
FIG. 2 is an enlarged exploded side view with parts broken away of the stringed instrument of FIG. 1 showing the structure therein.
Figure 3:
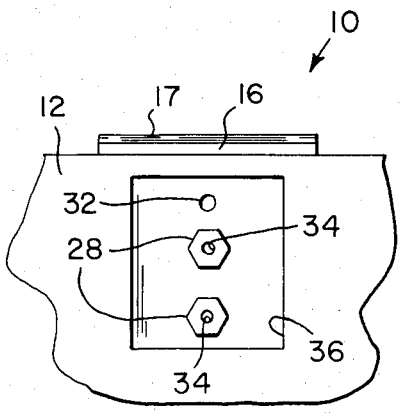
FIG. 3 is an enlarged end view with parts broken away as taken along line 3—3 in FIG. 1.

Turning now descriptively to the drawings, in which similar reference characters denote similar elements throughout the several views, FIGS. 1 through 3 illustrates an improved stringed instrument 10 of the type that has a body 12 with an elongated neck 14 extending therefrom. The neck 14 has a heel 15 adjacent the body 12. A fingerboard 16 has frets 17 thereon and is mounted onto the neck 14 and the body 12. The improvement consists of the neck 14 being removable from the body 12.

The neck 14 includes a bracket 18 mounted to back end 19 of the heel 15. The bracket 18 has an alignment post 20 extending therefrom and a pair of hex holes 26 spaced below the alignment post 20. The heel 15 has a pair of mounting holes 24 therein in alignment with the hex holes 26.

The body 12 has a recess 36 for receiving the bracket 18. The recess 36 has an alignment hole 32 for receiving the alignment post 20. A pair of hex bolts 28 that have threaded holes 34 therein are mounted within the recess 36 below the alignment hole 32 for receiving the hex holes 26 of the bracket 18. A pair of mounting bolts 22 are provided for extending through the mounting holes 24 in the heel 15 to thread within the threaded holes 34 of the hex bolts 28 for securing the neck 14 to the body 12. The neck 14 can be removed for storing the stringed instrument 10 in a smaller area. The hex bolts 28 are mounted within the recess 36 below the alignment holes 32 by a pair of securement bolts 30 from within the body 12.

Figure 4:
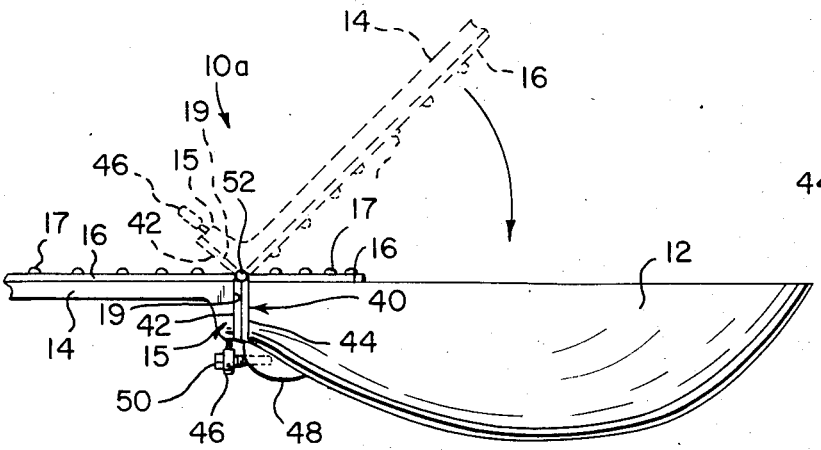
FIG. 4 is a side view with parts broken away of a second form of the invention in which the neck is hinged to the body of the stringed instrument.
Figure 5:
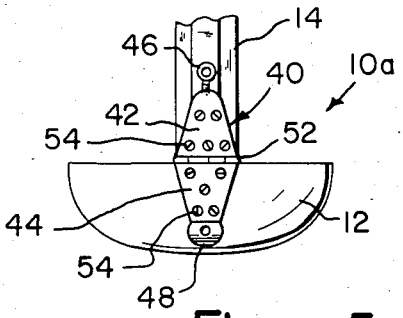
FIG. 5 is an end view with parts broken away of the stringed instrument of FIG. 4 with the neck partly pivoted upwardly over the body.

FIGS. 4 and 5 show another form **10*a* of the improved stringed instrument which includes a hinge 40 that has a first leaf 42 mounted to back end 19 of the heel 15 of the neck 14. A second leaf 44 is mounted to the body 12 so that barrels 52 of the hinge 40 will extend above to form one of the frets 17 on the fingerboard 16**.

An eyelet screw 46 is threaded into bottom of the heel 15. A threaded boss 48 is formed on the body 12 below the hinge 40. A securement bolt 50 is placed through the eyelet screw 46 to thread within the threaded boss 48 for securing the neck 14 down to the body 12. When the securement bolt 50 is removed, the neck 14 can be pivoted upwardly over the body 12 as shown in dotted lines in FIG. 4, so that the string instrument **10*a*** can be stored in a smaller area.

The first leaf 42 of the hinge 40 is mounted to the back end 19 of the heel 15 of the neck 14 and the second leaf 44 is mounted to the body 12 by a plurality of screws 54 as shown in FIG. 5.

The improved stringed instruments 10 and **10*a*** can especially be placed in limited spaces when not being used. When traveling, such as in a car, van, motorcycle, bicycle and the like, they will take up smaller areas than standard stringed instruments.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved stringed instrument of the type having a body with an elongated neck extending therefrom, said neck having a heel adjacent said body and a fingerboard having frets thereon, said fingerboard mounted onto said neck and said body, the improvement comprising:

(a) said neck being removable from said boy and including a bracket mounted to back end of said heel, said bracket having an alignment post extending therefrom and a pair of hex holes spaced below said alignment post, said heel having a pair of mounting holes therein in alignment with said hex holes;

(b) said body having a recess for receiving said bracket, said recess having an alignment hole for receiving said alignment post;

(c) a pair of hex bolts having threaded holes therein, said hex bolts mounted within said recess below said alignment hole for receiving said hex holes of said bracket; and (d) a pair of mounting bolts for extending through said mounting holes in said heel to thread within said threaded holes of said hex bolts for securing said neck to said body so that said neck can be removed for storing said stringed instrument in a smaller area.

2. An improved stringed instrument as recited in claim 1, wherein said hex bolts are mounted within said recess below said alignment hole by a pair of securement bolts from within said body.

3. An improved stringed instrument of the type having a body with an elongated neck extending therefrom, said neck having a heel adjacent said body and a fingerboard having frets thereon, said fingerboard mounted onto said neck and said body, the improvement comprising:

(a) a hinge having a first leaf mounted to back end of said heel of said neck and a second leaf mounted to said body so that barrels of said hinge will extend above to form one of said frets on said fingerboard;

(b) an eyelet screw threaded into bottom of said heel;

(c) a threaded boss formed on said body below said hinge; and (d) a securement bolt placed through said eyelet screw to thread within said threaded boss for securing said neck down to said body so that when said securement bolt is removed said neck can be pivoted upwardly over said body so that said stringed instrument can be stored in a smaller area.

4. An improved stringed instrument as recited in claim 3, wherein said first leaf of said hinge is mounted to said back end of said heel of said neck and said second leaf is mounted to said body by a plurality of screws.

* * * * *